United States Patent [19]

Hutchison

[11] 4,129,308

[45] Dec. 12, 1978

[54] PACKER CUP ASSEMBLY

[75] Inventor: Stanley O. Hutchison, Bakersfield, Calif.

[73] Assignee: Chevron Research Company, San Francisco, Calif.

[21] Appl. No.: 783,132

[22] Filed: Mar. 31, 1977

Related U.S. Application Data

[63] Continuation-in-part of Ser. No. 714,941, Aug. 16, 1976, abandoned.

[51] Int. Cl.[2] ..... F16J 15/10

[52] U.S. Cl. ..... 277/188 R

[58] Field of Search ..... 277/188 A, 188, DIG. 2

[56] References Cited

U.S. PATENT DOCUMENTS

| | | | |
|---|---|---|---|
| 3,720,410 | 3/1973 | Berg | 277/DIG. 10 |
| 3,810,639 | 5/1974 | Scannell | 277/188 R |

*Primary Examiner*—Robert I. Smith

*Attorney, Agent, or Firm*—R. L. Freeland, Jr.; Edward J. Keeling

[57] ABSTRACT

A packer cup assembly useful on tubing at high temperatures and includes a special sealing element having a frangible back up portion to provide pack off in a well.

6 Claims, 14 Drawing Figures

PACKER CUP ASSEMBLY

CROSS REFERENCE TO RELATED APPLICATION

This application is a continuation-in-part of application Ser. No. 714,941, filed Aug. 16, 1976, by Stanley O. Hutchison for "Packer Cup Assembly" which application is now abandoned.

This application is also related to application Ser. No. 706,862, filed July 19, 1976 for "New Heat Conductive Frangible Centralizers". The contents of such applications are hereby incorporated herein by reference.

FIELD OF THE INVENTION

The present invention relates to packer cups which are used on tubing positioned in a well to pack off the annular space between the tubing and a well casing or well lines to provide vertical isolation of a portion of such annular space to permit selective placement or removal of fluids into or out of formations penetrated by the well. More specifically the present invention relates to a packer cup which is particularly useful on tubing at high temperatures and which includes a special sealing element having a frangible back up portion to provide an adequate pack off for steam operations in a well and to facilitate removal of the tubing from the well should the tubing and packer cup be sanded in during such an operation in the well.

BACKGROUND OF THE INVENTION

Temperature and radioactive surveys while injecting steam to heat up viscous oil reservoirs have indicated that the steam tends to go into those zones previously treated. Cyclic steam stimulation becomes uneconomic when this occurs repeatedly. Also, the placement of steam in a steam drive in a thick productive section requires some sort of vertical zonal segregation to make the available thermal energy sufficiently concentrated to be effective. The use of packer cup assemblies is one way to achieve vertical zonal segregation. However, field evidence indicates that commercially available packer cup assemblies are not holding up under actual well conditions. Tests were made on many commercially available packer cup assemblies. Sealing elements of available packer cup assemblies were found to be not satisfactory. Further, available packer cup assemblies are not designed to permit easy washover as opposed to milling up if the assemblies become stuck in the hole.

Initially, it was thought that only a few psi pressure differential would be required to inject steam into a particular zone but this assumption was proven to be in error. A packer cup assembly was wanted which could be easily washed over or could be broken up and left in the bottom of the well. Most commercially available packer cups have a metal backup thimble which generally has an outside diameter 3/16 inch to ½ inch less than the inside diameter of the casing. Operators are reluctant to run multiple packer cup assemblies in a well where there is a history of sand production because the cups are often stuck by sand. The packer cup assemblies generally have to be cut and recovered singly or milled up because there is not wash-over clearance with the tight fitting metal backup thimbles. Therefore, there was need for a packer cup assembly which does not require metal backup thimbles or plates. If backup material is required it has to be made out of something that is frangible. Further, there is need for a packer cup assembly which will withstand reasonable pressure differential encountered at elevated temperatures and yet have the tubing string strong compared to the packer cup assembly so the tubing can be pulled from the well and the packer cup assembly dropped to the bottom of the well. Alternatively, it is desirable to be able to wash over the packer cup assembly with currently available wash pipe.

BRIEF DESCRIPTION OF THE INVENTION

The present invention is directed to a packer cup assembly for use on a tubing string located in a well to seal off the annular space between the outside of the tubing string and the inside of a well liner or casing string. The packer cup assembly includes a mandrel section which is connectable into a tubing string by suitable means such as conventional couplings. A sealing element which has a central opening is snugly fitted over the mandrel section. The sealing element has a base portion and a face portion including an annularly extending inner lip engaged against the mandrel section and an annularly extending outer lip engageable against the casing string or well liner. The inner lip and the outer lip are separated by an annularly extending groove portion. A frangible annularly extending backup ring is slidably engaged over the mandrel section. The backup ring has a face portion engaged against the base portion of the sealing element and a relatively flat base portion. The backup ring has a diameter slightly smaller than the diameter of the sealing element. Stop means on the mandrel section abuts against the flat base portion of the frangible backup ring to maintain the backup ring in a predetermined position on the mandrel section. The stop means have maximum radial dimension of substantially less than the outer diameter of the backup ring to permit washing over. In preferred form the frangible backup ring is formed of furfuryl alcohol filled cordierite which has a compressive strength of about 14,000 to 18,000 psi. The backup ring should have an outer diameter of between ¼ to ¾ of an inch less than the outer diameter of the sealing element. The stop means is preferably a metal ring having an outer diameter of at least one inch less than the outer diameter of the frangible backup ring and be formed of a material having a compressive strength of at least 50,000 psi.

PRINCIPAL OBJECT OF THE INVENTION

The principal object of the present invention is to provide a packer cup assembly for use in sealing off the annular space between a tubing string and a well liner or casing which assembly will withstand a hot high pressure environment and which is also easily removed should it and the tubing string become sanded up in the well. Additional objects and advantages of the present invention will become apparent from a detailed reading of the specification and the drawings which are incorporated herein and made a part of this specification.

DETAILED DESCRIPTION OF THE PREFERRED EMBODIMENT

Figure 1:
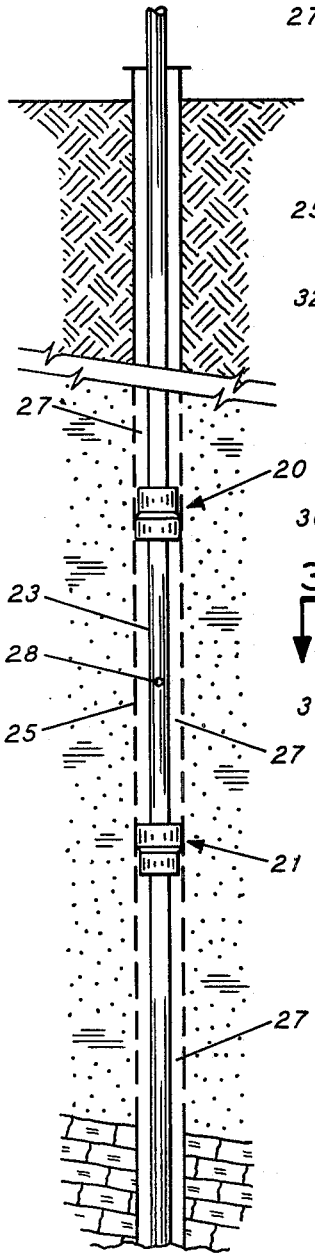
FIG. 1 is a schematic elevation view partially in section and illustrates apparatus assembled in accordance with the present invention position in a well adjacent a well liner.

FIG. 1 is an elevation view partially in section and illustrates packer cup assemblies generally indicated by the numerals 20 and 21 connected on a tubing string 23 located in a well in accordance with the present invention. The packer cup assemblies 20, 21 are positioned adjacent a portion of the slots in well liner 25. The upper packer cup assembly is looking down to prevent fluids in the tubing 23 — liner 25 annulus 27 from going up the well while the lower packer cup assembly 21 is looking up to prevent fluids in the annulus 27 from going further down the well. Thus, for example, in a steam injection operation where it is desired to inject steam into a particular interval the packer cup assemblies 20, 21 are spaced apart on the tubing string 23 to bridge the interval and the steam is injected down the tubing string 23 and out port 28 into annulus 27 and then forced out into the formation through the slots located in the liner 25 between the packer cup assembles 20, 21. The packer cup assemblies of the present invention are particularly useful in steam injection operations. However, they also find utility in many other conventional oilfield injection or production operations.

Figure 2:
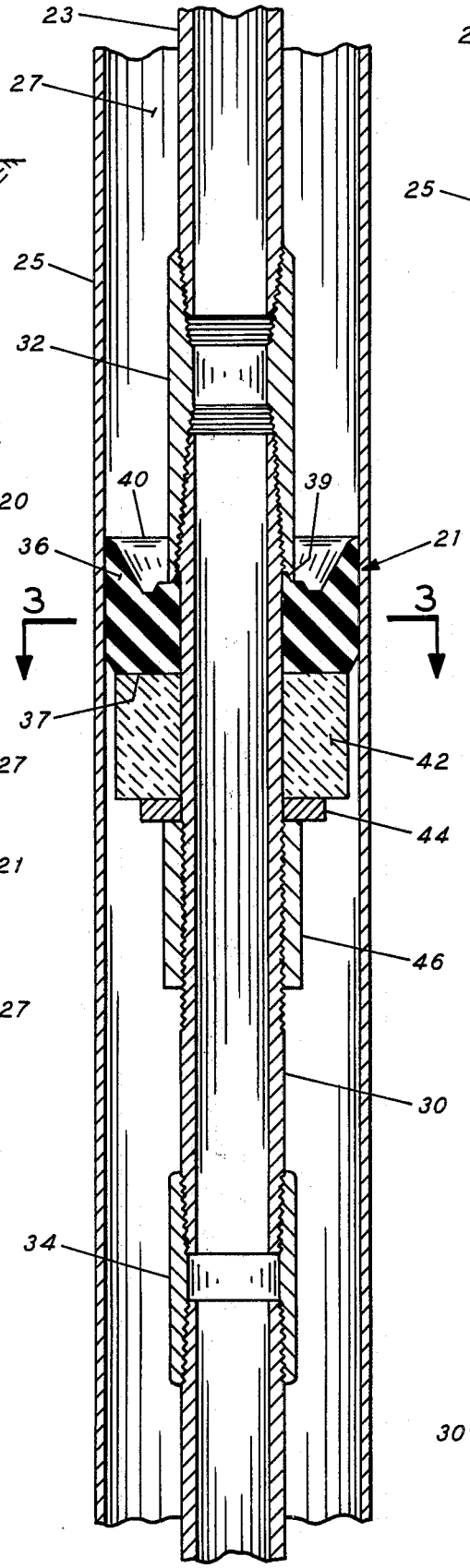
FIG. 2 is an elevation view with portions broken away for clarity of presentation and illustrates the preferred form of apparatus assembled in accordance with the present invention.
Figure 3:
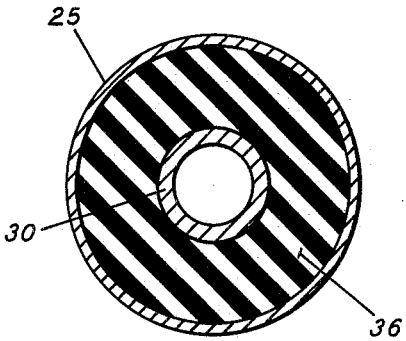
FIG. 3 is a sectional view taken at line 3—3 of FIG. 2.

FIG. 2 is an elevation view with portions broken away for clarity of presentation and FIG. 3 is a sectional view taken at line 3—3 of FIG. 2. These figures illustrate the preferred packer cup assembly of the present invention. The packer cup assembly 21 includes a mandrel section 30. The mandrel section 30 is connected into the tubing string 23 by suitable means such as coupling 32 and coupling 34. A sealing element 36 having a central opening fits in snug engagement over the mandrel section 30. The sealing element has a flat base portion 37 and a face portion including an annularly extending inner lip 39 engaged against the mandrel section 30 and an annularly extending outer lip 40 engaged against the liner or casing string. The inner lip 39 and the outer lip 40 are separated by an annularly extending groove portion in the sealing element 36. The lip portions are important to prevent fluid bypass of the sealing element.

A frangible annularly extending backup ring 42 is positioned behind the sealing element 36. The backup ring has a diameter slightly smaller than the sealing element to support the sealing element during high pressure operations. Preferably, the outer diameter of the backup ring is between $\frac{1}{4}$ to $\frac{3}{4}$ of an inch less than the outer diameter of the sealing element. The central opening of the backup ring slidably engages over the mandrel section 30. The backup ring has a face portion engaged against the base portion of the sealing element and has a relatively flat base portion. The material forming said frangible backup ring should have a compressive strength of more than 5,000 psi and less than 20,000 psi. The preferred material for forming the frangible backup ring is furfuryl alcohol filled cordierite. Stop means are provided on the mandrel section abutting against the flat base portion of the frangible backup ring to maintain the backup ring in a predetermined position on the mandrel section. The stop means should have a maximum radial dimension small enough to permit washover should the assembly become stuck in the well. Such a suitable dimension is usually at least about one inch less than the outer diameter of the backup ring. The stop means is preferably formed of a material having a tensile strength in excess of 50,000 psi. Thus, a metal ring 44 abuts against the flat base portion of the frangible backup ring 42. A jam nut collar 46 is threadably engaged on the mandrel section 30 and follows the metal ring 44 to maintain the sealing element 36 and the frangible backup ring 42 in a predetermined position on the mandrel section.

Figure 4:
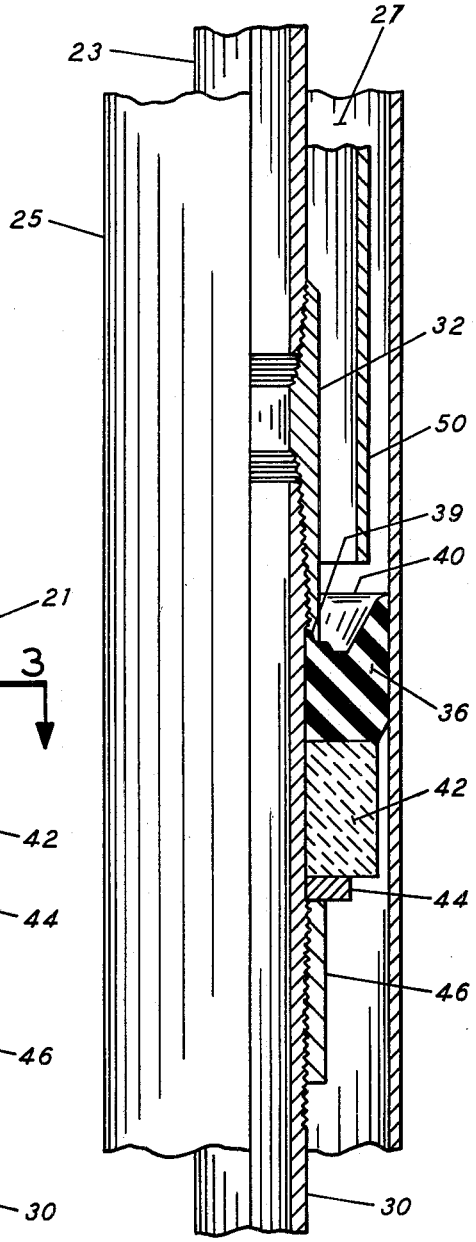
FIG. 4 is an elevation view with portions broken away for clarity of presentation and illustrates the preferred form of apparatus position in a well and includes a wash pipe being moved into position to wash over the packer cup assembly.

FIG. 4 is an elevation view with portions broken away for clarity of presentation and illustrates the preferred packer cup assembly positioned in a well and includes a wash pipe 50 being moved into position to wash over the packer cup assembly if, for example, the tubing string should become stuck in the hole due to sanding up the packer cup assembly. Thus, washover pipe 50 is forced down over the sealing element 36 and breaks the frangible backup ring 42. The wash pipe 50 is of sufficient inside diameter to clear the metallic ring 44 and jam nut collar 46. Fluid such as foam is circulated down the washover pipe 50 and up the wash pipe 50 — liner 25 annulus to remove sand from the well to free the tubing string.

Figure 5:
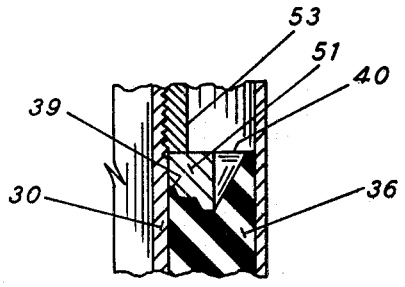
FIG. 5 is a partial elevation view and illustrates an alternative embodiment of apparatus assembled in accordance with the present invention.
Figure 13:
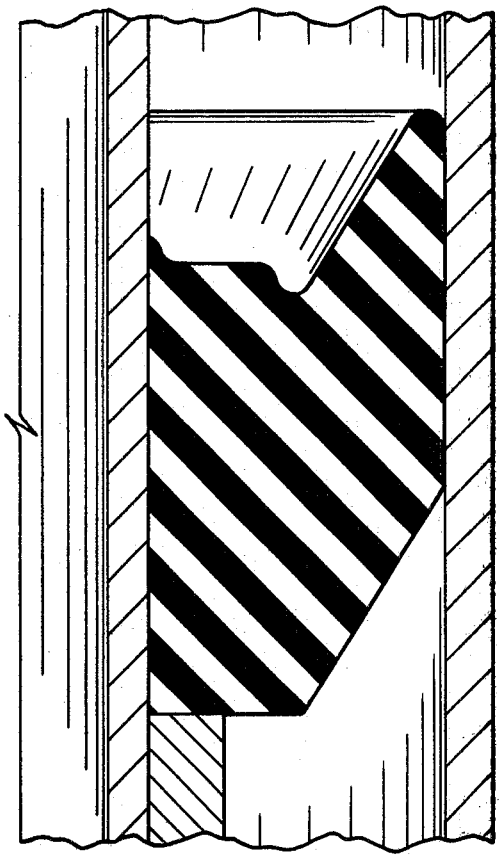
FIG. 6 to FIG. 13 inclusive are schematic sectional views illustrating various forms of sealing elements and backup rings which were unsuccessful.

FIG. 5 illustrates an alternative embodiment of apparatus assembled in accordance with the present invention. In some instances it has been found desirable to eliminate the possibility of the sealing element 36 from slipping up over connector 53 as the tubing string is being run into the well. This is accomplished by means of a hold down clamp 51 which is fixedly secured to the tubing string and engages into the annularly extending groove in the sealing member between the inner lip 39 and the outer lip 40.

A number of sealing element and backup ring configurations were tested under various conditions of pressure and temperature in a test facility. FIGS. 6–13 schematically illustrate arrangements which were found not satisfactory. Thus, the configuration of FIG. 6 leaked at the casing with 1 psi pressure in the tubing-casing annulus. The FIG. 7 configuration, without an inner lip, held no pressure and leaked out the tubing. The FIG. 8 configuration where the rubber sealing element was 65–70 shore hardness slipped over the backup ring at 200 psi. The FIG. 9 arrangement where an upper rubber sealing element having a 65–70 shore hardness was backed up by a rubber element of 95 shore hardness slipped over the backup ring at 475 psi. The configuration of FIG. 10 leaked at the casing at 200 psi when a 65–70 shore hardness sealing element was used. A 95 shore hardness element leaked at the casing at 245 psi. The FIG. 11 arrangement with an element having a shore hardness of 95 leaked at the casing at 250 psi. The FIG. 12 arrangement held 800 psi in the lab test, however, failed at 175 psi in a field test. It is believed that the aluminum backup ring failed. The FIG. 13 embodiment leaked at the casing at 50 psi.

Figure 14:
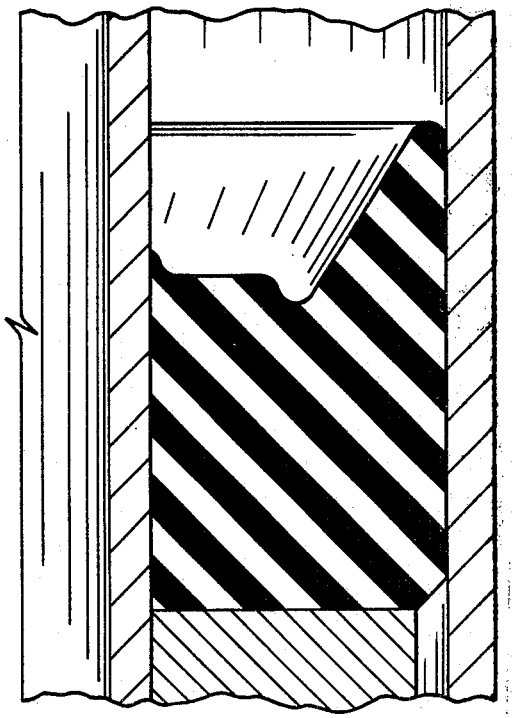
FIG. 14 is a schematic sectional view illustrating the sealing element and backup ring of the present invention.
Figure 10:
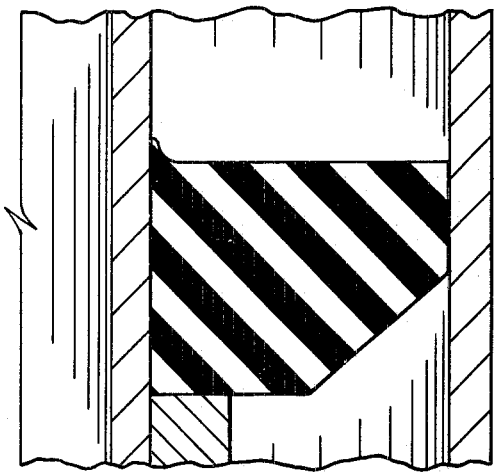
Figure 11:
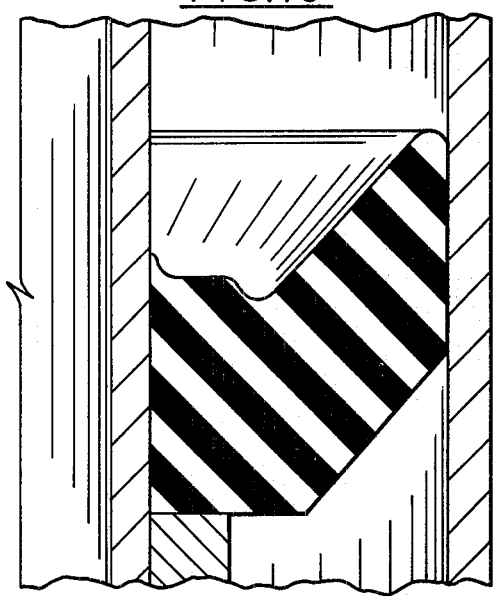
Figure 12:
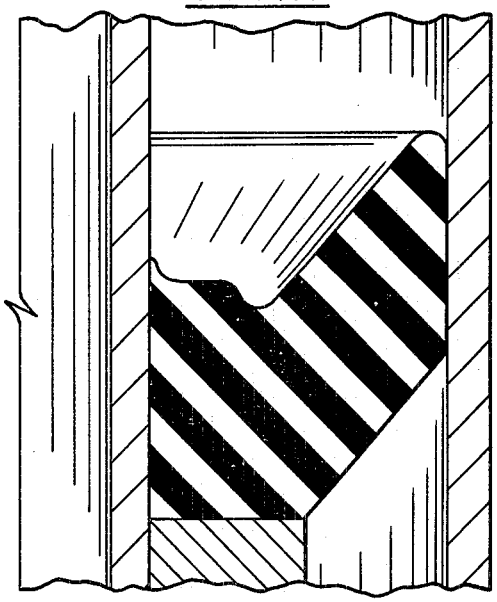
Figure 6:
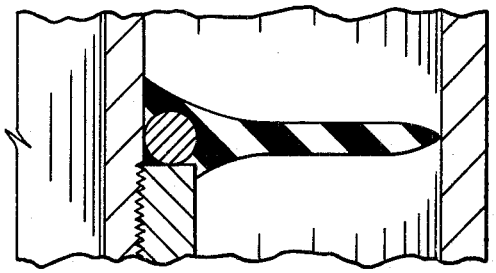
Figure 7:
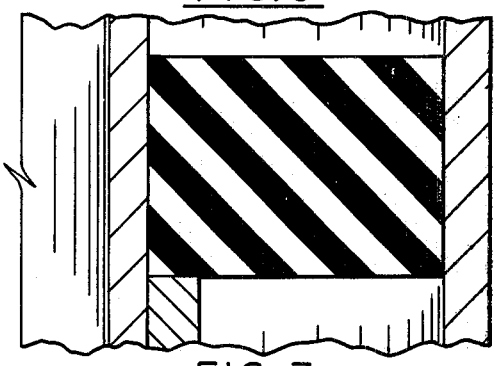
Figure 8:
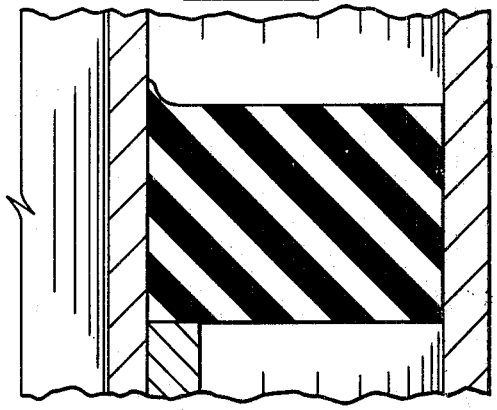
Figure 9:
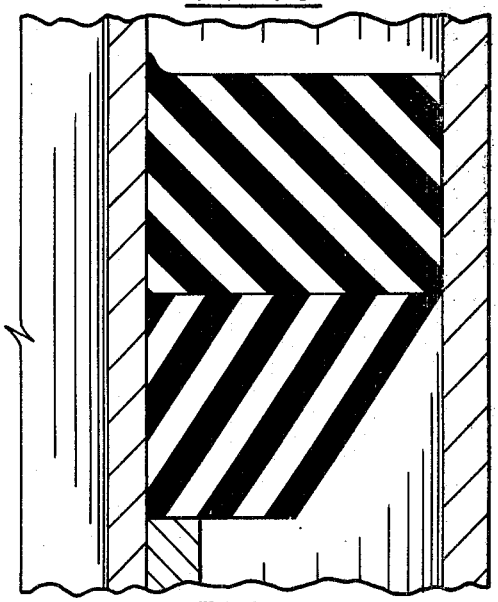

The FIG. 14 embodiment in accordance with the present invention operated successfully during a six-day test at 800 psi and 520° F. Thus the physical configuration of the sealing element and the frangible backup ring of FIG. 14 showed superior results. A number of demonstrations were conducted with different sealing elements made from different material to select a suitable material for high temperature operations. A small pressure vessel was installed on a steam injection well, where material samples could be placed and steam flowed over them under actual well conditions. The following rubber materials were tested at 345 to 500 psi pressure and 440° to 475° F. temperature:

Viton
Polyacrylic
Ethylene propylene (EPDM)
Butyl
Neoprene
Nitrile
Hycar rubber
Styrene Butadiene rubber (SBR)
Buna S Ethylene propylene was the only rubber material to hold its resiliency under over an 18 month test period after which the test was terminated. All other materials failed in a steam environment within 48 hours.

Three samples of Hycar rubber, neoprene and ethylene propylene were tested in hot and cold crude oil and in hot and cold solvent. The samples placed in ambient temperature crude oil showed no apparent change. After 50 hours of hot (165° F.) and 64 hours of ambient temperature (114 hours total), the ethylene propylene showed 10% swelling with good stretch return. The Neoprene showed slight swelling and softening but excellent stretch return. The Hycar rubber showed no effects whatsoever. However, after 72 hours (8 hours hot [165° F.] and 64 hours ambient temperature), in the solvent the ethylene propylene sample showed 25% swelling with complete loss in stretch return. The Neoprene sample also showed 25% swelling but did not lose as much stretch return or strength. The Hycar rubber sample was only slightly softened with no swelling or serious loss of strength.

The demonstrations and physical configurations test indicated that ethylene propylene is the only rubber material tested that does not get hard and brittle in a steam environment. Its performance in cold crude oil is acceptable. It should probably not be based in hot crude oil and definitely not in high aromatic solvents. It will not bond to metal. Hycar rubber and Neoprene have good to excellent resistance to hydrocarbons but perform very poorly in steam. These materials easily bond to metal. The rubber sealing element in a packer cup assembly tends to "cold-flow" when its backup plate outside diameter is ½ inch smaller than the inside diameter of the casing. The sealing element of a packer cup assembly that is unsupported tends to fail on its internal seal or bond. All commercially available packer cup assemblies failed to hold pressure at elevated temperatures. The sealing element of packer cup of the present invention held pressure at elevated temperatures. The large mass of rubber in the present sealing element allows a certain amount of cold and hot flow with sufficient rubber material left to still form a seal. The packer cup assembly of the present invention with the frangible backup ring is the only packer assembly that is effective in steam service and can be "washed over".

Various materials were tested in a search to discover a suitable material for use as the frangible backup ring of the present invention. A small pressure vessel was installed on a steam injection well, where material samples were placed and steam flowed over them under actual well conditions.

The following materials were tested at 450° F. to 475° F. temperature and 575 to 650 psi pressure:

Cordierite
Pyrex
Furfuryl alcohol
Various fiberglass compounds
Various polylite compounds
Various polyester compounds
Polyethylene molding material
Casting resins
Styrene and asbestos mixtures Cordierite, pyrex and furfuryl alcohol resins were the only materials that were competent after being in this environment for seven days. The cordierite surface tended to soften up when in wet steam which resulted in poor wear characteristics. However, when the cordierite was filled with polymerized furfuryl alcohol, the wear characteristics and compressive strength were improved. Subsequent tests with pyrex indicated that it fractured easily and was very expensive to get in specialty sizes. It has not been possible to cast pure furfuryl alcohol resins without gas bubbles which lowered the compressive strength to an unacceptable level.

A typical chemical analysis of cordierite after being fired is:

| | |
|---|---|
| $SiO_2$ | 51.4% |
| $Al_2O_3$ | 13.1 |
| MgO | 34.0 |
| Others | 1.5 |
| | 100.0% |

The following are the strength and thermal properties of cordierite and other materials:

Compressive Strength

Unfilled cordierite — 2,575 to 7,830 psi
Furfuryl filled cordierite — 14,000 to 18,300 psi
Concrete — 2,500 psi
Structural steel — 60,000 psi Thermal Conductivity (BTU-in/hour, ft/° F.)
Unfilled cordierite — 6.4
Furfuryl filled cordierite — 6.0
Air — 0.163
Cork board — 0.3
Steel — 300.0
Copper, pure — 2,616.0

The frangible backup rings are formed from polymerized furfuryl alcohol impregnated cordierite. Cordierite is a mixture of dry clays mixed to a dough-like consistency with 20% to 30% by volume water, extruded or molded to the proper shape, room dried to remove excessive water and fired in a kiln at 2400° F. for 24 hours. The lugs are then put into a pan containing furfuryl alcohol containing a suitable catalyst in vacuum to remove air from the lugs to insure complete impregnation of the furfuryl into the lug. The lugs are removed from the pan to drain excess furfuryl. The lugs are put into an oven and the temperature is maintained at 160° F. to polymerize the furfuryl alcohol in about 40 minutes. A suitable furfuryl alcohol-catalyst system is described in U.S. Pat. No. 3,850,249, issued Nov. 26, 1974, to Patrick H. Hess and assigned to Chevron Research Company, San Francisco, Calif.

Although certain specific embodiments have been described in detail herein, the invention is not limited only to those embodiments but rather by the scope of the appended claims.

What is claimed is:

1. A packer cup assembly comprising a mandrel section connectable into a tubing string, a sealing element having a central opening in snug engagement over said mandrel section, said sealing element having a base portion and a face portion including an annularly extending inner lip engaged against said mandrel section and an annularly extending outer lip engageable against a casing string, said inner lip and said outer lip being separated by an annularly extending groove portion, a frangible annularly extending backup ring having an outer diameter of less than the outer diameter of said sealing element and a central opening slidably engageable over said mandrel section, said backup ring having a face portion engaged against the base portion of said sealing element and having a relatively flat base portion and stop means on said mandrel section abutting against the flat base portion of said frangible backup ring to maintain said backup ring in a predetermined position on said mandrel section, said stop means having a maximum radial extension less than said backup ring and small enough to permit washover if the assembly becomes stuck in a well.

2. A packer cup assembly comprising a mandrel section connectable into a tubing string, a sealing element having a central opening in snug engagement over said mandrel section, said sealing element having a base portion and a face portion including an annularly extending inner lip engaged against said mandrel section and an annularly extending outer lip engageable against a casing string, said inner lip and said outer lip being separated by an annularly extending groove portion, a frangible annularly extending backup ring having an outer diameter of less than the outer diameter of said sealing element and a central opening slidably engageable over said mandrel section, said backup ring having a face portion engaged against the base portion of said sealing element and having a relatively flat base portion and stop means on said mandrel section abutting against the flat base portion of said frangible backup ring to maintain said backup ring in a predetermined position on said mandrel section, said stop means having maximum radial extension of at least about one inch less than the outer diameter of said backup ring.

3. A packer cup assembly comprising a mandrel section connectable into a tubing string; a resilient sealing element having a central opening in snug engagement over said mandrel section, said sealing element having a base portion and a face portion including an annularly extending inner lip engaged against said mandrel section and an annularly extending outer lip engageable against a casing string, said inner lip and said outer lip being separated by an annularly extending groove portion; a frangible annularly extending backup ring having an outer diameter of between ¼ to ¾ of an inch less than the outer diameter of said sealing element and a central opening slidably engageable over said mandrel section, said backup ring having a face portion engaged against the base portion of said sealing element and having a relatively flat base portion, the material forming said frangible backup ring having a compressive strength of between 5,000 and 20,000 psi; and stop means on said mandrel section abutting against the flat base portion of said frangible backup ring to maintain said backup ring in a predetermined position on said mandrel section, said stop means having maximum radial extension of at least about one inch less than the outer diameter of said backup ring and said stop means being formed of a material having a compressive strength in excess of 50,000 psi.

4. The packer cup assembly of claim 3 further characterized in that said resilient sealing element is formed of ethylene propylene.

5. The packer cup assembly of claim 3 further characterized in that a hold down clamp is fixedly secured to said tubing string and engages against the face portion of said sealing element to prevent said sealing element from sliding on said mandrel section.

6. The apparatus of claim 3 where said stop means is a metal ring.

* * * * *